US007713150B2

(12) United States Patent
Hart

(10) Patent No.: US 7,713,150 B2
(45) Date of Patent: May 11, 2010

(54) METHOD OF USING MODIFIED BALL AND BAT

(76) Inventor: Alan H. Hart, 1738 E. Delaware St., Evansville, IN (US) 47711

( * ) Notice: Subject to any disclaimer, the term of this patent is extended or adjusted under 35 U.S.C. 154(b) by 0 days.

(21) Appl. No.: 11/847,224

(22) Filed: Aug. 29, 2007

(65) Prior Publication Data

US 2007/0293358 A1 Dec. 20, 2007

Related U.S. Application Data

(62) Division of application No. 10/908,574, filed on May 17, 2005, now abandoned.

(51) Int. Cl.
*A63B 67/00* (2006.01)

(52) U.S. Cl. ..... 473/468

(58) Field of Classification Search ..... 473/468, 473/465, 415, 289, 128, 514; 124/5; 273/317
See application file for complete search history.

(56) References Cited

U.S. PATENT DOCUMENTS 1,168,808 A * 1/1916 Von Hoffman ..... 124/5
3,169,019 A * 2/1965 Genjack ..... 473/457
4,930,772 A * 6/1990 Maloney et al. ..... 473/457

* cited by examiner

*Primary Examiner*—Gene Kim
*Assistant Examiner*—M Chambers
(74) *Attorney, Agent, or Firm*—Eric R. Wandel

(57) ABSTRACT

The present invention provides a method for a batter to position a ball for hitting and therefore provides a method for playing the game of baseball without a pitcher. The ball is slidingly engaged with the baseball bat such that the baseball bat hitting end is inserted through a bore through the ball, the ball can be tossed into the air in front of the batter with a flipping motion of the bat, and the batter can strike the ball with a batting motion to deliver the ball into the field of play.

1 Claim, 4 Drawing Sheets

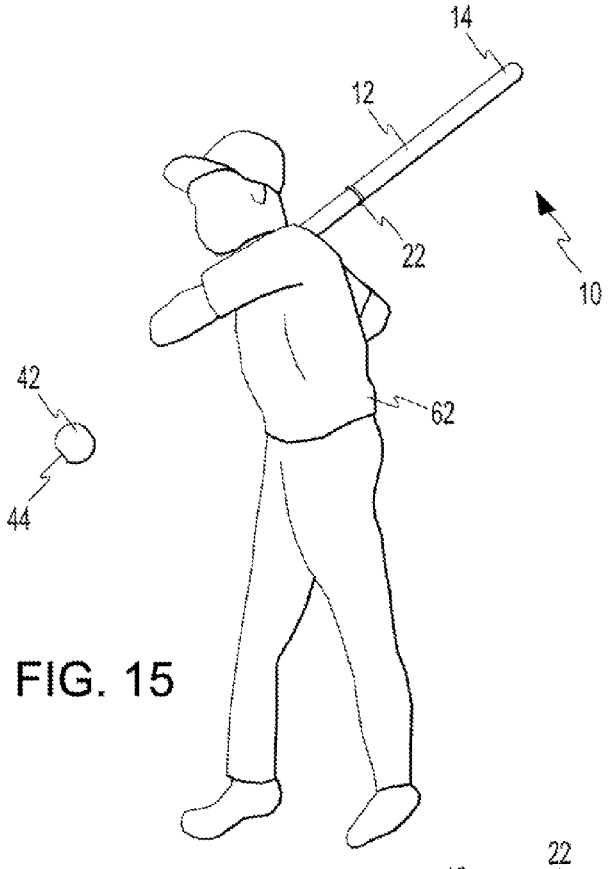
FIG. 15
FIG. 16
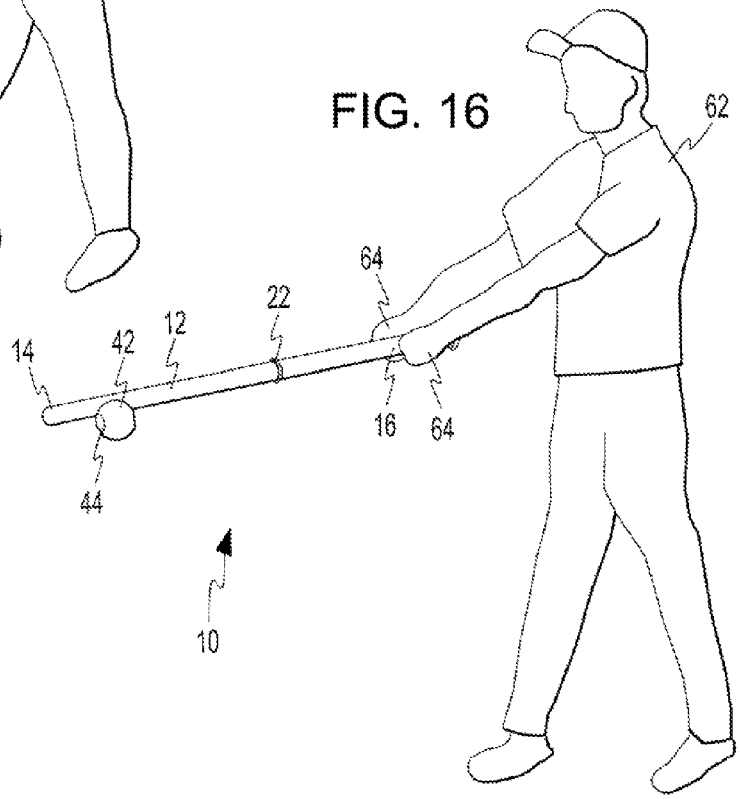

METHOD OF USING MODIFIED BALL AND BAT

FIELD OF THE INVENTION

The present invention relates to the field of baseball playing equipment and to a method of playing baseball. More specifically, the present invention is concerned with a bat, a modified ball that is slidingly engaged upon said bat, and a method of delivering said ball from said bat to field of play.

BACKGROUND OF THE INVENTION

The game of baseball typically involves a pitcher throwing a baseball to a batter so that the batter can hit the baseball into the field of play for advancing to a subsequent base or scoring a run. The game typically requires at least several people—a batter, a person or pitcher throwing a baseball to the batter, a catcher, and at least one person fielding the baseball after said baseball is hit. In many cases, though, the requisite number of people is unavailable to play baseball at the most basic level. For instance, if only two people are available, a decision must be made as to who will bat, pitch, catch, or field the ball—the most basic positions. In many cases, a compromise is made, wherein the game is played without the pitcher and catcher. In this situation, the batter, striving to hit the ball without benefit of the pitcher throwing the ball to the batter, improvises various methods as a substitute for the pitcher, such as tossing the ball into the air with one hand and quickly grasping the bat with both hands and swinging the bat toward the falling ball in order to hit the ball before it drops to the ground. Such a method of hitting a baseball can lead to unsatisfactory results as the batter must undertake and concentrate on several tasks at once, thereby compromising the ability of the batter to focus on and hit the baseball in a manner that takes full advantage of the batter's capabilities.

The present invention provides a method by which the game of baseball can be played when no pitcher is available. The present invention allows the batter to concentrate more fully on hitting or otherwise delivering the baseball to the field of play without the distractions or encumbrances heretofore experienced by batters playing baseball without benefit of a pitcher.

DISCUSSION OF THE PRIOR ART

Numerous designs for baseball bats, baseballs, and methods of hitting a baseball with a baseball bat or otherwise delivering a baseball to field of play have been provided in the prior art. Even though these designs may be suitable for the specific individual purposes to which they address, they are generally elaborate in construction and cumbersome to use, thereby limiting the ability of a batter to hit or otherwise deliver a ball to field of play without benefit of a pitcher. These designs are exemplified by the following patents:

U.S. Pat. No. 4,006,900, Magnetic Baseball, Bat And Glove, issued to DiVito on 8 Feb. 1977;

U.S. Pat. No. 5,388,822, Attachment For A Bat, issued to Cassady on 14 Feb. 1995;

U.S. Pat. No. 6,565,462, Practice Baseball Bat, issued to Gregg on 20 May 2003.

Additionally, designs exist for toys that allow a projectile of some sort to be launched by the flinging motion of a stick. These devices, however, are used only to fling a projectile or ball away from the user and do not disclose or anticipate the method of the present invention which involves striking a ball with a bat. These designs are exemplified by the following patents:

U.S. Pat. No. 1,168,808, Toy or Gaming Device, issued to Hoffmann on 18 Jan. 1916.

U.S. Pat. No. 5,129,650, Apparatus and Method for Playing Golf, issued to Hayman on 14 Jul. 1992.

As such, it may be appreciated that there is a continuing need for a new and improved bat and ball combination along with a method of manipulating said bat and ball that allows a batter to hit or otherwise deliver a ball to field of play without benefit of a pitcher throwing a ball to said batter. In these respects, the present invention substantially departs from the conventional concepts and designs of the prior art, and in so doing provides a method that substantially fulfills this need. Additionally, the prior patents and commercial techniques do not suggest the present inventive combination of component elements arranged, configured and utilized in the method as disclosed herein.

The present invention achieves its intended purposes, objects, and advantages through a new, useful and unobvious combination of method steps and component elements, with the use of a minimum number of functioning parts, at a reasonable cost to manufacture, and by employing only readily available materials.

SUMMARY OF THE INVENTION

Described briefly, according to a first embodiment, the invention presents a bat, a ball designed to be slidingly engaged upon said bat, and method of hitting or otherwise delivering said ball to field of play without benefit of a pitcher throwing said ball to a batter. The bat in a first embodiment thereof is comprised of an elongate cylindrical member having a first handle end and a second opposing hitting end. The handle end of the cylindrical member is configured to allow ease of gripping by a batter. The bat is grasped nominally by both hands of a batter at the handle end of the cylindrical member. A ball stop may be located on the cylindrical member between handle end and hitting end thereof. In one embodiment, a ball stop is a raised ring around the circumference of the cylindrical member of the baseball bat such that the outer diameter of the ball stop ring is larger than the diameter of the cylindrical member.

The ball stop ring may be integral to the bat, such as being molded or otherwise formed into the material—such as plastic, wood or metal—used to make the bat. In this embodiment, the ball stop ring would be in a fixed position on the bat.

In another embodiment of the ball stop ring, the ring is made of an elastic material such as rubber or other polymer material. This embodiment of the ball stop ring can be relocated at various positions upon the cylindrical member of the bat and maintained in said position by means of the ring frictionally engaging said cylindrical member. The elastic ball stop ring may be in the form of an o-ring that has an inside diameter that is somewhat smaller than the diameter of the bat and thus requires being stretched in order to be placed around the cylindrical member of the bat and is therefore in frictional engagement with the bat. Alternatively, the ball stop ring may be similar to a common rubber band where the band is looped over multiple times in order to stretch the band taught around the circumference of the cylindrical member of the bat.

In yet another embodiment of the ball stop, the bat is comprised of an elongate cylindrical member having a first handle end and a second opposing hitting end. The handle end of the cylindrical member is configured to allow ease of gripping by a batter. The cylindrical member is further comprised of a first section and a second section, which meet a common junction. The first section of the cylindrical member tapers from a narrower diameter at the hitting end thereof to a wider diameter at said junction with the second section, and the second section tapers from a narrower diameter at the handle end thereof to a wider diameter at said junction with the first section. It is the wider diameter near the junction that serves as the ball stop in this embodiment.

In another embodiment of the bat used in the method of the present invention, a conventional bat with no fixed ball stop can be used, and the position of the ball along the length of the bat can be controlled either by manually positioning the ball along the length of the bat with one hand or by checking the movement of the ball due to gravity by holding the bat in a horizontal position when the ball is at a desired position along the length of the bat.

A ball designed to be slidingly engaged upon the bat is comprised with at least one bore extending through the center of the ball. In an alternate embodiment of the ball, two bores extend through said ball in generally perpendicular relation to each other. The diameter of the bores is somewhat larger than the overall diameter of the cylindrical member at the hitting end of the bat and less than the diameter of the ball stop in its various embodiments.

During use of the bat and ball as described herein, a batter grasps a bat, for instance the first embodiment thereof, at the handle end. The ball is situated upon a ground surface with the bore thereof disposed generally upward toward the batter. The batter inserts the cylindrical member of the bat at the hitting end thereof into the bore of the ball, substantially occupying said bore. The batter then lifts the bat up so that the hitting end is higher than the handle end, thereby forcing by gravity the ball toward the ball stop. The ball eventually makes contact with the ball stop, at which point its movement is checked. The batter then makes a rapid upward motion (an upward flipping motion) of the bat so that the ball is caused to slide off of the hitting end of the bat into the air in front of the batter. At such time, the batter swings the bat so that the bat strikes the ball by swinging the bat back and then forward, hitting the ball as it descends in front of the batter.

In another embodiment of the bat, the wider diameter junction of first and second sections of the cylindrical member functions as the ball stop.

It can be appreciated that a number of equivalent devices could be used as a ball stop, including a protruding ring integral to the bat or any number of means in order to extend the diameter of the bat to a diameter greater than the diameter of the bore through the ball in order to check the sliding engagement of the ball along the bat. Other methods of checking the sliding engagement of the ball along the bat include using any type of protrusion or protrusions around the perimeter of the cylindrical member of the bat at the desired position of the ball stop—such as by using pegs or pins that protrude in at least one position on the bat so that the ball cannot slide past the protrusion. It can be appreciated that there are a number of means of forming the ball stop. Also, as mentioned, the means of effecting the ball stop may be accomplished by manual positioning with one hand of the batter or by holding the bat horizontally when the ball is in the desired location on the bat.

In order that the detailed description of the invention may be better understood and that the present contribution to the art can be more fully appreciated, additional features of the invention will be described hereinafter. It should be appreciated by those skilled in the art that the conception and the disclosed specific methods and structures may be readily utilized as a basis for modifying or designing other structures for carrying out the same purposes of the present invention. It should be realized by those skilled in the art that such equivalent methods and structures do not depart from the spirit and scope of the invention.

In this respect, it is to be understood that the invention is not limited in its application to the details of construction and to the arrangements of the components set forth in the following description or illustrated in the drawings. The method of the invention is capable of being practiced using other embodiments and of being practiced and carried out in various ways. Also, it is to be understood that the phraseology and terminology employed herein are for the purpose of description and should not be regarded as limiting. Embodiments described herein have made reference to a baseball bat and a baseball for ease of conceptualizing the functionality of the invention, however it is to be understood that other ball and bat sports—such as whiffle ball, softball and cricket—can make similar use of this invention.

Accordingly, it is an object of the invention to provide an improved method for ball and bat based sports play without the need for a pitcher.

For a better understanding of the invention, its operating advantages and the specific objects attained by its uses, reference should be made to the accompanying drawings and descriptive matter in which there are illustrated preferred embodiments of the device used in the method of this invention. The foregoing has outlined some of the more pertinent objects of the invention. These objects should be construed to be merely illustrative of some of the more prominent features and applications of the present invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiments in addition to the scope of the invention illustrated by the accompanying drawings.

BRIEF DESCRIPTION OF THE DRAWINGS

The foregoing and other objects, features and advantages of the invention will become more fully understood from the following description of the preferred embodiments of the invention as illustrated in the accompanying drawings in which like reference characters refer to the same parts throughout different views. The drawings are not necessarily to scale, emphasis instead being placed upon illustrating the principles of the invention.

FIG. 15 is a perspective view of a batter ready to swing the bat after said ball has slid off said bat and is located in mid-air in accordance with the present version of the invention.

FIG. 16 is a perspective view of a batter striking the ball with the bat in accordance with the present version of the invention.

DRAWING REFERENCE NUMERALS

Figure 1:
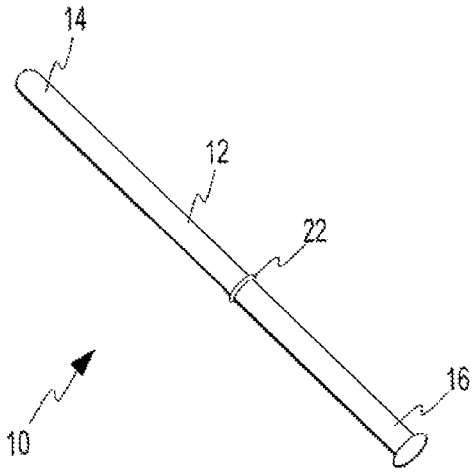
FIG. 1 is a perspective view of a first embodiment of a bat having a ball stop in accordance with the present version of the invention.

The following table lists the drawing reference numerals with a brief description of each identifying numeral.

| | |
|---|---|
| 10 | Baseball Bat, First Embodiment |
| 12 | Cylindrical Member |
| 14 | Hitting End |
| 16 | Handle End |
| 22 | Ball Stop |
| 24 | Baseball Bat, Second Embodiment |
| 26 | Cylindrical Member |
| 28 | Hitting End |
| 30 | Handle End |
| 36 | First Section of Tapered Bat |
| 38 | Second Section of Tapered Bat |
| 40 | Junction |
| 42 | Ball with Single Bore |
| 44 | Bore |
| 46 | Ball with Double Bore |
| 48 | Bore |
| 50 | Bore |
| 52 | Ball with Single Bore |
| 54 | Bore |
| 56 | Ball with Double Bore |
| 58 | Bore |
| 60 | Bore |
| 62 | Player |
| 64 | Hand |

DETAILED DESCRIPTION OF THE PREFERRED EMBODIMENTS

Figure 2:
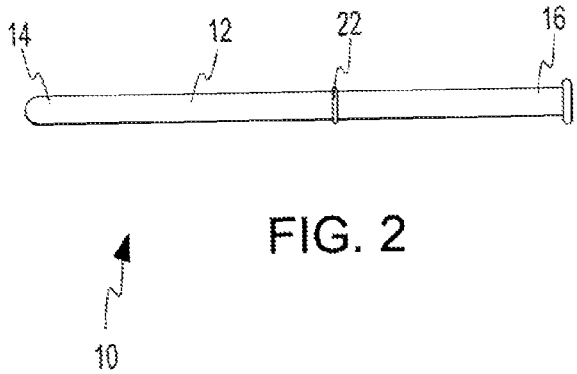
FIG. 2 is an elevation view of a first embodiment of a bat having a ball stop in accordance with the present version of the invention.

Referring now to the drawings and, in particular, to FIG. 1 and FIG. 2 wherein there are illustrated a first embodiment of the baseball bat 10. This version of the bat 10 consists of an elongate, cylindrical member 12 having a handle end 16 and an opposing hitting end 14. A ball stop 22 is located on the cylindrical member 12 at a ball stop position between the handle end 16 and the hitting end 14.

In one embodiment, the ball stop 22 is made of an elastic material similar to a rubber o-ring or a rubber band so that said ball stop 22 can be repositioned at various positions along the cylindrical member 12 and retain said position thereon by frictionally engaging the outer surface of the cylindrical member 12. The ball stop 22 can be repositioned as desired to optimize placement along the cylindrical member 12.

In another embodiment, the ball stop 22 is integral to bat 10 where the ball stop 22 is molded, formed, turned by lathe or otherwise permanently integrated at a fixed position onto the cylindrical member 12.

Figure 3:
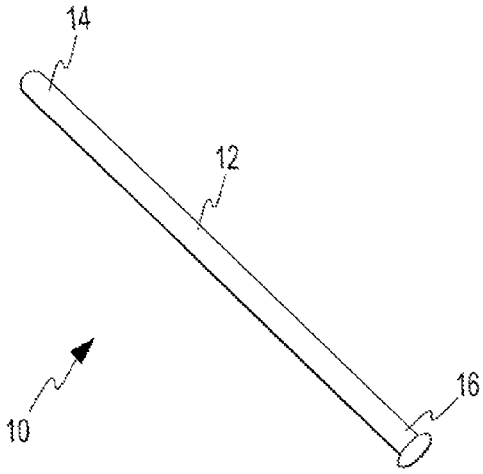
FIG. 3 is a perspective view of a first embodiment of a bat without a ball stop.
Figure 4:
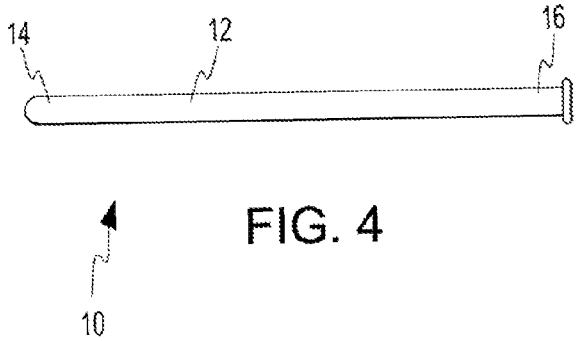
FIG. 4 is an elevation view of a first embodiment of a bat without a ball stop.

Referring to FIG. 3 and FIG. 4, therein illustrated is the bat 10 without the ball stop 22 upon the cylindrical member 12. In this example, a ball with a central bore therethrough can slide unimpeded from the hitting end 14 to the opposed handle end 16 of the cylindrical member 12.

Figure 5:
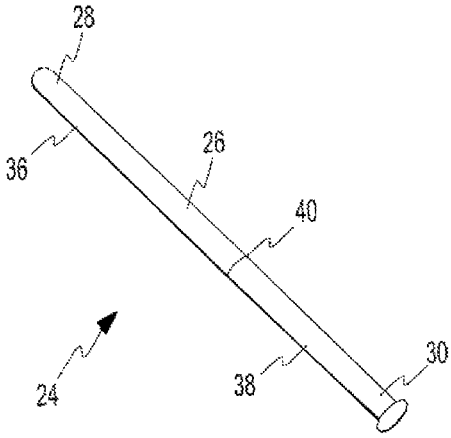
FIG. 5 is a perspective view of a second embodiment of a bat having a tapered profile in accordance with the present version of the invention.
Figure 6:
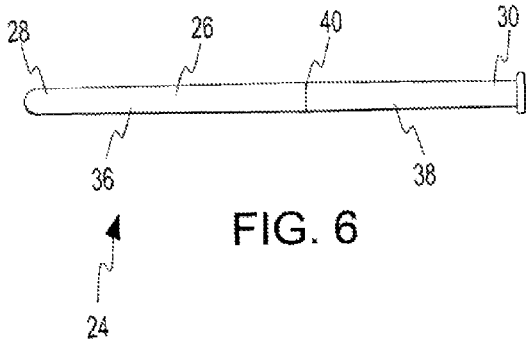
FIG. 6 is an elevation view of a second embodiment of a bat having a tapered profile in accordance with the present version of the invention.

In FIG. 5 and FIG. 6, a second embodiment of the bat 24 is illustrated. The bat 24 is comprised of an elongate, substantially cylindrical member 26 having hitting end 28 and an opposing handle end 30. The cylindrical member 26 is further comprised of a first section 36 and a second section 38, said sections 36 and 38 meeting at junction 40. More particularly, the first section 36 of the cylindrical member 26 tapers from a narrower diameter at the hitting end 28 to a wider diameter at junction 40 with the second section 38, and the second section 38 tapers from a narrower diameter at the handle end 30 thereof to a wider diameter at junction 40 with the first section 36.

Figure 7:
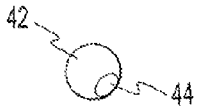
FIG. 7 is a perspective view of a first embodiment of a ball having a single bore in accordance with the present version of the invention.
Figure 8:
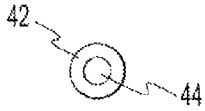
FIG. 8 is an elevation view of a first embodiment of a ball having a single bore in accordance with the present version of the invention.

A first embodiment of a ball 42 intended for use with the bats 10, 24 is illustrated in FIG. 7 and FIG. 8. A substantially circular bore 44 extends through the baseball 42 along the widest diameter thereof. The diameter of the bore 44 is somewhat larger than the overall diameter of the cylindrical member 12 of the first embodiment of the bat 10 and less than the diameter of the ball stop 22. When used in conjunction with the second embodiment of the bat 24, the diameter of the bore 44 is somewhat larger than the overall diameter of the cylindrical member 26 at the hitting end 28 of the second embodiment of the bat 24 and less than the diameter of the junction 40 of first 36 and second 38 sections thereof.

Figure 9:
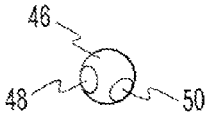
FIG. 9 is a perspective view of a second embodiment of a ball having two orthogonal bores in accordance with the present version of the invention.

A second embodiment of the ball 46 is illustrated in FIG. 9. A first substantially circular bore 48 extends through the ball 42 along the widest diameter thereof, and a second substantially circular bore 50 extends through the ball 42 along the widest diameter thereof in generally orthogonal relation to the axis of the first circular bore 48.

The diameter of the bores 48, 50 is somewhat larger than the overall diameter of the cylindrical member 12 of the first embodiment of the bat 10. When used in conjunction with the second embodiment of the bat 24, the diameter of the bores 48, 50 is somewhat larger than the overall diameter of the cylindrical member 26 at the hitting end 28 of the second embodiment of the bat 24 and less than the diameter of the junction 40 of first 36 and second 38 sections thereof.

Figure 10:
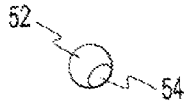
FIG. 10 is a perspective view of a third embodiment of a ball having a single bore in accordance with the present version of the invention.
Figure 11:
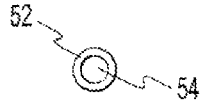
FIG. 11 is an elevation view of a third embodiment of a ball having a single bore in accordance with the present version of the invention.

A third embodiment of the ball 52 is illustrated in FIG. 10 and FIG. 11. A substantially circular bore 54 extends through the ball 52 along the widest diameter thereof. The diameter of the bore 54 is somewhat larger than the overall diameter of the cylindrical member 12 of the first embodiment of the bat 10. When used in conjunction with the second embodiment of the bat 24, the diameter of the bore 54 is somewhat larger than the overall diameter of the cylindrical member 26 at the hitting end 28 of the second embodiment of the bat 24 and less than the diameter of the junction 40 of first 36 and second 38 sections thereof.

Figure 12:
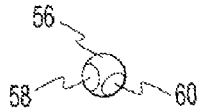
FIG. 12 is a perspective view of a fourth embodiment of a ball having two orthogonal bores in accordance with the present version of the invention.

A fourth embodiment of the baseball 56 is illustrated in FIG. 12. A first substantially circular bore 58 extends through the baseball 56 along the widest diameter thereof, and a second substantially circular bore 60 extends through the baseball 56 along the widest diameter thereof in orthogonal relation to the axis of the first circular bore 58. The diameter of the bores 58, 60 is somewhat larger than the overall diameter of the cylindrical member 12 of the first embodiment of the bat 10. When used in conjunction with the second embodiment of the bat 24, the diameter of the bores 58, 60 is somewhat larger than the overall diameter of the cylindrical member 26 at the hitting end 28 of the second embodiment of the bat 24 and less than the diameter of the junction 40 of first 36 and second 38 sections thereof.

Figure 13:
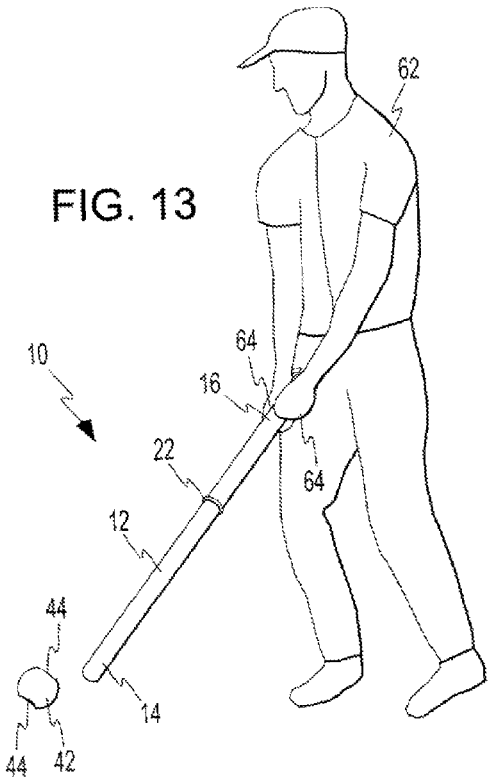
FIG. 13 is a perspective view of a batter picking up a ball off a ground surface with the bat in accordance with the present version of the invention.

Referring now to FIG. 13 through FIG. 16 therein are illustrated a first method of delivering a ball 42 into field of play using the bat 10. In FIG. 13, the ball 42 with one bore 44 is situated upon a ground surface with the bore 44 aligned upwardly from the ground surface. A batter 62 grasps the bat 10 upon the cylindrical member 12 at the handle end 16 thereof with both hands 64 and directs the hitting end 14 of the bat 10 toward the bore 44 of the ball 42. The batter 62 then inserts the bat 10 at the hitting end 14 of the cylindrical member 12 into the bore 44 of the ball 42 so that the cylindrical member 12 substantially occupies the bore 44. If necessary, the batter 62 can use one of the balls 46, 56 with two bores in order to facilitate the positioning of a ball 46, 56 upon the ground surface so that the cylindrical member 12 of the bat 10 can be more easily inserted into respective bores 48, 50, 58, 60 since the additional bore adds an additional insertion point. Alternatively, the ball 42 can be placed on the bat 10 by hand where the batter holds the ball 42 and manually fits the bore 44 of the ball 42 onto the hitting end 14 of the bat 10.

Figure 14:
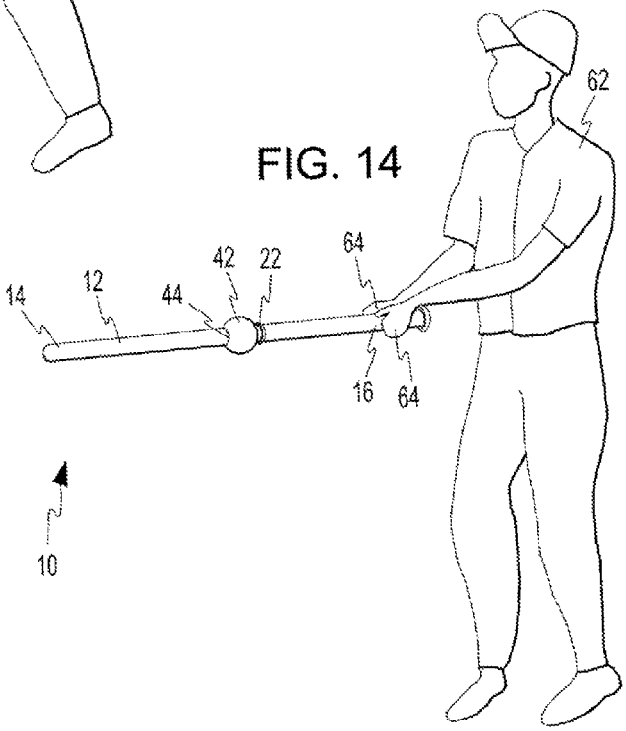
FIG. 14 is a perspective view of a batter sliding the ball along the bat until said ball makes contact with the ball stop in accordance with the present version of the invention.

As illustrated in FIG. 14, the batter 62 raises the hitting end 14 of the bat 10 above the ground so that the ball 42, situated upon the bat 10 with the bore 44 thereof receiving a portion of the cylindrical member 12, can slide along the portion of the cylindrical member 12 between the hitting end 14 thereof and the ball stop 22 and toward the ball stop 22. The batter 62 manipulates the bat 10 in various positions or configurations, such as slightly dropping the hitting end 14 of the cylindrical member 12 or rotating the bat 10 to cause the ball 42 to slide along the cylindrical member 12 and away from the ball stop 22 so that the ball 42 eventually slides off and becomes separated from the bat 10. A rapid rotation of the bat 10 about a center of rotation near the handle end 16 of the bat 10 where that hitting end 14 is rapidly rotated, or flipped, in an upward motion serves to separate the ball 42 from the bat 10 such that that ball 42 slides off of the hitting end 14 of the bat 10 and is propelled upward in from of the batter 62. As shown in FIG. 15, the ball 42 is separated from the bat 10 in mid-air at a position where the ball 42 would otherwise be over home plate if the ball 42 were being thrown to the batter 62 by a pitcher. The batter 62 then quickly swings the bat 10 back upon one shoulder to assume a familiar hitting stance. As shown in FIG. 16, the batter 62 swings the bat 10 toward the ball 42 so that the bat 10 strikes the ball 42 upon the cylindrical member 12 proximate to the hitting end 14 thereof.

Using the aforementioned methods of play, the batter 62 using said bat 10 and ball 42 can deliver the ball 42 to the field of play without the necessity of having a pitcher throw the ball toward the batter 62.

In the second embodiment of the bat 24, the junction 40 of first 36 and second 38 sections of the cylindrical member 26 functions in a similar manner as the ball stop 22 of the first embodiment of the bat 10, i.e., controlling movement and location of the ball 42 upon the cylindrical member 26 of the bat 24 to produce desired velocity and direction of the ball 42 as said ball 42 becomes separated from the cylindrical member 26 of the bat 24. The While this version of the invention has been illustrated and described in detail in the drawings and foregoing description, the same is to be considered as illustrative and not restrictive in character, it being understood that only the preferred embodiments have been shown and described and that all changes and modifications that come within the spirit of the version of the invention are desired to be protected.

For instance, alternate versions of first 10 and second 24 embodiments of the bat can be provided with various lengths and diameters. The bat and ball may be taken as representative of baseball, softball, whiffle ball or cricket in addition to any other forms of recreation involving a bat and a ball.

From the foregoing, it will be understood by persons skilled in the art that an improved method of delivering a batted ball into a field of play has been provided. The invention is relatively simple and easy to manufacture, yet affords a variety of uses. While my description contains much specificity, these should not be construed as limitations on the scope of the version of the invention, but rather as an exemplification of the preferred embodiments thereof. The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

Although this invention has been described in its preferred form with a certain degree of particularity, it is understood that the present disclosure of the preferred form has been made only by way of example and numerous changes in the details of construction and combination and arrangement of parts may be resorted to without departing from the spirit and scope of the invention.

What is claimed is:

1. A method of delivering a ball into a field of play, comprising the steps of:

1) Providing a uniquely styled striking instrument having a substantially cylindrical bat extending between a handle end and a hitting end, the bat including a first section proximate the handle end and a second section proximate the hitting end, the first and second sections meeting at a junction between the handle end and hitting end; wherein, the second section transitions from a narrow first diameter at the hitting end to a wider second diameter at said junction;

2) Providing a uniquely styled ball having a substantially spherically shape with an outer surface, the outer surface of the ball defining at least one substantially cylindrical bore through the center of the ball, the bore having a third diameter, where the third diameter is greater than the first diameter and less than the second diameter of the bat;

3) Placing the ball on the bat by manually positioning the bore of the ball around the hitting end of the bat;

4) Placing the ball on the bat such that the bore is in sliding engagement with the hitting surface of the hitting end of the bat;

5) Rotating the bat along a rotation axis proximate the handle end of the bat so that the hitting end of the bat moves in a rapid upward motion causing the ball to slide along the hitting surface of the bat in a direction from the handle end toward the hitting end and to become separated from the bat as the hitting end of the bat approaches an upward orientation, where the ball follows a substantially vertical trajectory rising;

6) Attempting to strike the ball with the bat as the ball descends toward the playing area.

* * * * *